US007867058B2

(12) United States Patent
Sweeney

(10) Patent No.: US 7,867,058 B2
(45) Date of Patent: Jan. 11, 2011

(54) SPORTS BRA

(76) Inventor: Nancy-Jane Sweeney, 3 Field Rd., Derry, NH (US) 03038

( * ) Notice: Subject to any disclaimer, the term of this patent is extended or adjusted under 35 U.S.C. 154(b) by 0 days.

(21) Appl. No.: 11/787,729

(22) Filed: Apr. 17, 2007

(65) Prior Publication Data

US 2008/0261489 A1 Oct. 23, 2008

(51) Int. Cl.
*A41C 3/00* (2006.01)

(52) U.S. Cl. ..... 450/89; 450/1; 2/247

(58) Field of Classification Search ..... 450/89, 450/39, 58, 54, 57, 36; 2/267, 247
See application file for complete search history.

(56) References Cited

U.S. PATENT DOCUMENTS 2,593,711 A * 4/1952 Weatherly ..... 450/89
2,624,881 A * 1/1953 Lee ..... 450/89
6,176,761 B1 * 1/2001 Underhill ..... 450/89
6,464,717 B1 * 10/2002 Smith et al. ..... 607/108
6,517,410 B1 * 2/2003 Underhill ..... 450/1
6,811,464 B2 * 11/2004 Li ..... 450/57
6,824,444 B2 * 11/2004 Huang ..... 450/57

* cited by examiner

*Primary Examiner*—Gloria Hale

(57) ABSTRACT

A sports bra having an integral storage integral pouch disposed within the cleavage portion is disclosed. The integral integral pouch is formed by a top opening between two ply of the multi-ply material that the sports bra is comprised of and first and second edges that are formed within the multi-ply material. The multi-ply material is laminated together and has universal elasticity to provide support for the wearer as well as the necessary tension to hold an object stored in the integral pouch in place. The first and second edges are formed by sewing and the distance between the first and second edges is selected to be slightly less than the width of an object to be stored within the integral pouch. In addition, the top opening may be such that the length of the top opening is slightly less than the distance between the first and second edges.

15 Claims, 3 Drawing Sheets

SPORTS BRA

BACKGROUND

This invention relates generally to clothing and more particularly to sports bras for women.

Fitness has become an important consideration among women. Women today enjoy running, walking, biking, aerobics, and weight lifting. Often a woman will want to listen to music while exercising and desires to bring along an mp3 player or other small portable music device. These devices, while small, must either be carried, attached to a piece of clothing, or carried in belt pack or other pack.

The inclusion within a bra of a structure to hold or store an item is known. Some storage devices are clipped onto the bra via clips. These storage devices tend to be conspicuous and not aesthetically pleasing. Other prior art storage devices were built inside one or both of the cups. While more aesthetically pleasing, these devices are typically less comfortable and less accessible for the wearer. Still other prior art devices affix a compartment to the inside of the bra across the inside portion of the cups and cleavage area that is typically closed with a zipper or other rigid closing means to maintain the shape of the bra. These devices solve the aesthetic issues but render a significant portion of the bra inelastic. Other prior art devices use additional material attached to the bra itself to form a pocket. These devices are typically less structurally sound and the additional material may pull away from the bra during exercise and allow any objects contained therein to fall out.

Thus, there is a need for a bra with a storage integral pouch that does not alter the elasticity of the bra itself, is structurally sound and not prone to come loose during exercise, is comfortable, and is aesthetically pleasing.

SUMMARY

A sports bra having an integral storage integral pouch disposed within the cleavage portion is disclosed. The integral pouch is formed by a top opening between two-ply of the multi-ply material that the sports bra is comprised of and first and second edges that are formed within the multi-ply material. The multi-ply material is laminated together and has universal elasticity to provide support for the wearer as well as the necessary tension to hold an object stored in the integral pouch in place. The first and second edges may be formed by sewing and the distance between the first and second edges may be selected to be slightly less than the width of an object to be stored within the integral pouch or the distance may be substantially equal to the width of the object to be stored. In addition, the top opening may be such that the length of the top opening is slightly less than the distance between the first and second edges.

A sports bra is disclosed that includes a pair of cups that are joined by a cleavage portion that is between the proximate edges of the pair of cups. The sports bra also includes a back strap portion that is between the distal edges of the pair of cups and a pair of shoulder straps disposed between the pair of cups and the back portion. The sports bra is constructed of a multi-ply laminated material having universal elasticity to provide the necessary support for the wearer.

An integral pouch is formed between a top opening formed between the plies of the laminated material and first and second edges formed within the multi-ply material. The integral pouch is formed within the cleavage portion of the sports bra, the top opening has a first length, and the distance between the first and second edges is a second length. The integral pouch has an interior portion within which an object may be stored.

In one embodiment, the integral pouch is formed between the top and bottom of the sports bra extending the entire height thereof. In another embodiment, the integral pouch is less than the height of the sports bra and further includes a bottom edge formed roughly perpendicular to the first and second edges and formed between the first and second edges to completely enclose the interior of the integral pouch.

In one embodiment, the distance between the first and second edges is selected to be slightly less than the object to be held therebetween. The length of the top opening may be selected to be substantially equivalent to the distance between the first and second edges, or the length of the top opening may be slightly less than the distance between the first and second edges.

This is the second paragraph under the summary.

BRIEF DESCRIPTION OF THE DRAWINGS

These and other features, aspects, and advantages of the present invention will become better understood with regard to the following description, appended claims, and accompanying drawings. The drawings are not necessarily to scale, emphasis instead being placed on illustration of principles of the invention. The drawings include the following figures:

DETAILED DESCRIPTION OF THE DRAWINGS

The present invention may be understood by the following detailed description, which should be read in conjunction with the attached drawings. The following detailed description of certain embodiments is by way of example only and is not meant to limit the scope of the present invention.

Figure 1:
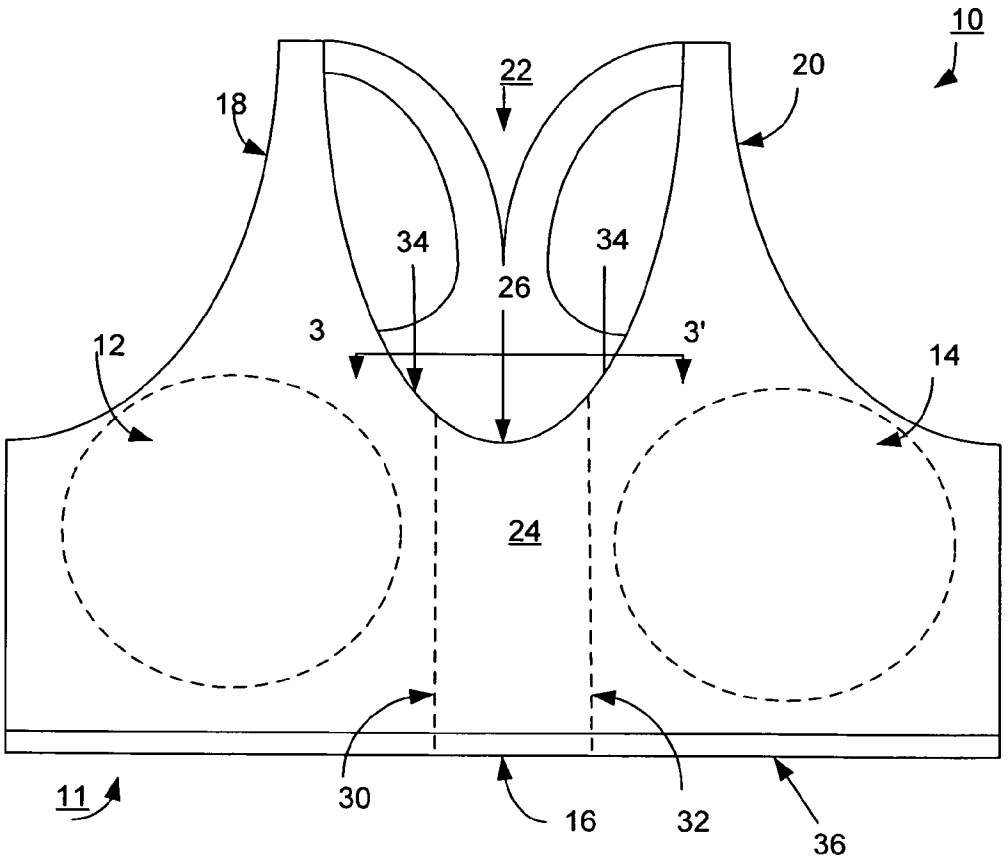
FIG. 1 is a front elevation view of an embodiment of the present invention.
Figure 2:
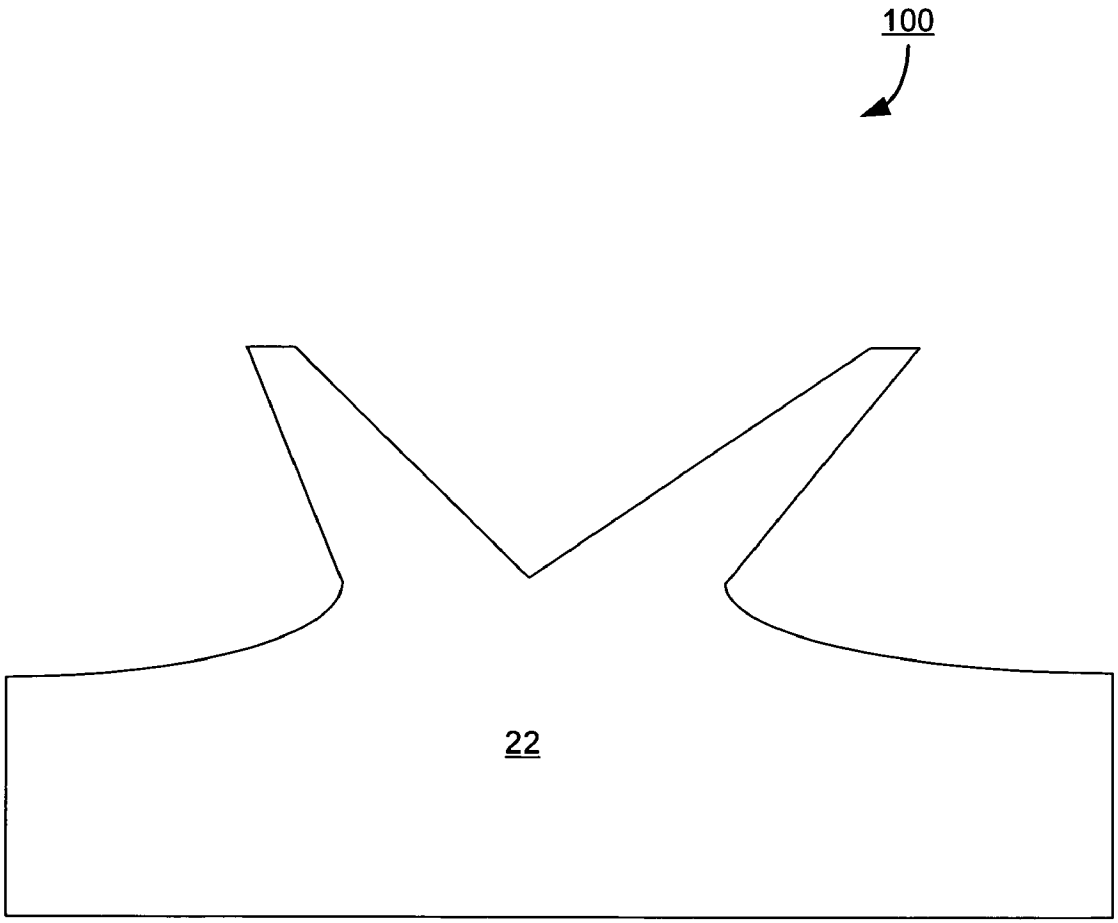
FIG. 2 is a back elevation view of an embodiment of the present invention.

FIGS. 1 and 2 depict a sports bra 10 having front portion 11 including a pair of cups 12 and 14 joined by a cleavage portion 16 disposed between the proximate edges of the cups 12 and 14. A back portion 22 is disposed between the distal edges of cups 12 and 14 and straps 18 and 20 are provided connecting the front portion 11 to the back portion 22.

Typically the sports bra 10 will be constructed of two or more plies of material sewn or otherwise laminated together to provide sufficient tensile strength. In addition, the two or more plies form a laminated structure that is universally elastic so as to provide adequate support and comfort to the wearer.

Figure 3:
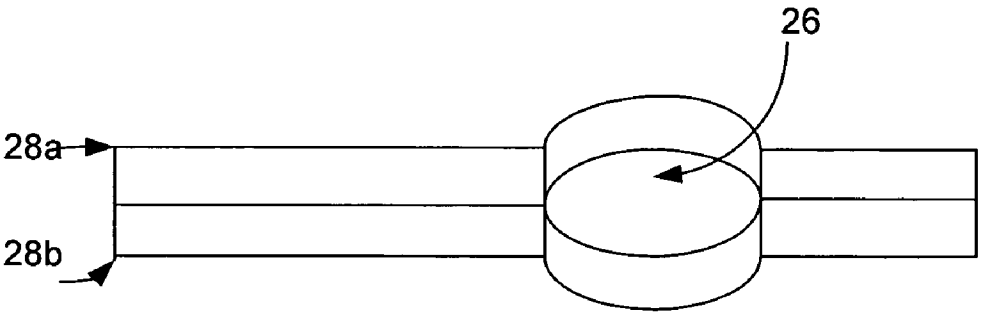
FIG. 3 is cross sectional view taken along line 3-3' of FIG. 1.

As depicted in FIGS. 1 and 3, an integral pouch 24 is formed within the structure of the sports bra 10 by forming a top opening 26 between the two or more plies 28*a* and 28*b* that form the sports bra 10 and by sewing or otherwise forming two edges 30 and 32 of the integral pouch 24. Although a two-ply structure is shown, it should be obvious to one of ordinary skill in the art that the integral pouch may be formed between any number of plies. Typically, the top opening 26 will be made in the middle of the plies with an equal number of plies on each side of the top opening 26. Typically, the edges 30 and 32 are formed by sewing from the edges 34 to the bottom edge 36. If needed, the edges 36 and 38 may be folded over to provide greater strength.

In one embodiment, the distance between edges 30 and 32 is selected to be just slightly smaller than the width of the object that is to be placed in integral pouch 24. In this embodiment, the universal elastic characteristic of the multi-ply material will contract around the object, effectively holding the object in place. In another embodiment, the distance the between edges 30 and 32 is selected to be substantially the same size as the object to be stored. In either of these embodiments, the top opening 26 may be made slightly smaller than the size of the object to be stored such that the universal elastic characteristic of the multi-ply material will cause the top opening 26 to contract and prevent the object from falling out of integral pouch 24.

As discussed above, the integral pouch 24 is formed between the bottom edge 38, side edges 30 and 32 and the top opening 26. In this way, the height of the integral pouch 24 is substantially equal to the height between the edge 34 and bottom edge 36. In some instances, the object to be placed in integral pouch 24 may be much shorter than the height between the edge 34 and bottom edge 36. In this instance, the object may move within integral pouch 24 causing discomfort for the wearer. In this instance, the integral pouch 24 may be made shorter by forming a pouch bottom edge (not shown) extending between the edges 30 and 32.

While the present invention has been particularly shown and described with references to preferred embodiments thereof, it will be understood by those skilled in the art that various changes in form and details may be made therein without departing from the spirit and scope of the invention as defined by the appended claims. All the features disclosed in this specification, including any accompanying claims, abstract, and drawings, may be replaced by alternative features serving the same, equivalent or similar purpose, unless expressly stated otherwise.

What is claimed is:

1. A sports bra capable of holding an object between the breasts of a user, said bra comprising:

a pair of cups, said cups joined by a cleavage portion said cleavage portion being disposed between a proximate edge of each of said pair of cups said cleavage portion having a height and width, a back strap portion disposed between a distal edge of each of said pair of cups, a pair of shoulder straps disposed between said pair of cups and said back portion, said bra being constructed of first and second ply laminated material having substantially universal elasticity; and a top opening formed between first and second-plies of said laminated material wherein said top opening allows communication between an interior portion of said sports bra formed between said first and second plies and an exterior, said top opening being disposed within the cleavage portion of cleavage portion and an exterior, said top opening having a length, an integral pouch being formed within said interior portion of said sports bra between said first and second plies being formed by first and second edges, said first and second edges and said integral pouch being formed within said cleavage portion and said first and second edges being spaced apart from one another having a distance therebetween, said integral pouch having an interior pouch portion formed by said top opening and said first and second edges within said first and second plies within which an object may be stored.

2. The sports bra of claim 1 wherein the top opening has a length that is less than said distance between said first and second edges.

3. The sports bra of claim 1 wherein the first and second edges are separated between 1 and 2¼ inches.

4. The sports bra of claim 3 wherein the first and second edges are separated between 1 and 1¼ inches.

5. The sports bra of claim 4 wherein the top opening has a length of between ¾ and 1⅛ inches.

6. The sports bra of claim 3 wherein the first and second edges are separated between 1¼ and 1½ inches.

7. The sports bra of claim 6 wherein the top opening has a length of between 1⅛ and 1⅜ inches.

8. The sports bra of claim 3 wherein the first and second edges are separated between 1½ and 1¾ inches.

9. The sports bra of claim 8 wherein the top opening has a length of between 1⅜ and 1⅝ inches.

10. The sports bra of claim 3 wherein the first and second edges are separated between 1¾ and 2 inches.

11. The sports bra of claim 10 wherein the top opening has a length of between 1⅝ and 1⅞ inches.

12. The sports bra of claim 3 wherein the first and second edges are separated between 2 and 2¼ inches.

13. The sports bra of claim 12 wherein the top opening has a length of between 1⅞ and 2⅛ inches.

14. The sports bra of claim 1 further comprising a top edge and a bottom edge wherein said height of said sports bra is between said top edge and said bottom edge, wherein said first and second edges extend from said top edge to said bottom edge and said integral pouch is formed the entire height of said sports bra.

15. The sports bra of claim 1 further comprising a top edge and a bottom edge and a integral pouch bottom edge, wherein said height of said sports bra is between said top edge and said bottom edge, wherein said first and second edges begin at said top edge and extend a portion of said height, said integral pouch formed between said top opening, said first and second edges, and said integral pouch bottom edge.

* * * * *